US007308957B2

(12) United States Patent
Cariveau et al.

(10) Patent No.: US 7,308,957 B2
(45) Date of Patent: Dec. 18, 2007

(54) FIXED-HEAD BIT WITH STABILIZING FEATURES

(75) Inventors: Peter Thomas Cariveau, Spring, TX (US); Bala Durairajan, Houston, TX (US); Sujian J. Huang, Beijing (CN)

(73) Assignee: Smith International, Inc., Houston, TX (US)

( * ) Notice: Subject to any disclaimer, the term of this patent is extended or adjusted under 35 U.S.C. 154(b) by 245 days.

(21) Appl. No.: 11/037,553

(22) Filed: Jan. 18, 2005

(65) Prior Publication Data

US 2006/0157279 A1 Jul. 20, 2006

(51) Int. Cl.
*E21B 10/46* (2006.01)

(52) U.S. Cl. ..... 175/428

(58) Field of Classification Search ..... 175/425, 175/426, 428, 432
See application file for complete search history.

(56) References Cited

U.S. PATENT DOCUMENTS

| | | | | |
|---|---|---|---|---|
| 4,942,933 | A * | 7/1990 | Barr et al. | 175/431 |
| 4,991,670 | A * | 2/1991 | Fuller et al. | 175/428 |
| 5,007,493 | A * | 4/1991 | Coolidge et al. | 175/432 |
| 5,090,492 | A * | 2/1992 | Keith | 175/408 |
| 5,431,239 | A * | 7/1995 | Tibbitts et al. | 175/428 |
| 5,607,024 | A * | 3/1997 | Keith et al. | 175/431 |
| 6,568,492 | B2 | 5/2003 | Thigpen | |
| 6,659,199 | B2 * | 12/2003 | Swadi | 175/57 |
| 6,779,613 | B2 * | 8/2004 | Dykstra et al. | 175/57 |
| 6,883,623 | B2 * | 4/2005 | McCormick et al. | 175/408 |
| 6,935,441 | B2 * | 8/2005 | Dykstra et al. | 175/57 |
| 2004/0140132 | A1 * | 7/2004 | Middlemiss | 175/428 |
| 2005/0269139 | A1 * | 12/2005 | Shen et al. | 175/430 |
| 2006/0124358 | A1 * | 6/2006 | Mensa-Wilmot | 175/57 |

FOREIGN PATENT DOCUMENTS

| | | |
|---|---|---|
| GB | 2 369 140 A | 5/2002 |
| GB | 2 378 718 A | 2/2003 |
| GB | 2 393 982 A | 4/2004 |

OTHER PUBLICATIONS

Combined Search and Examination Report issued in corresponding British Application No. GB0600822.1; Dated May 23, 2006; 5 pages.
Office Action dated Apr. 26, 2007 issued by the Canadian Intellectual Property Office in Canadian Application No. 2,532,762, 2 pages.
Office Action dated May 1, 2007 issued by the European Patent Office in U.K. Application No. GB0600822.1, 2 pages.

* cited by examiner

*Primary Examiner*—David Bagnell
*Assistant Examiner*—Daniel P Stephenson
(74) *Attorney, Agent, or Firm*—Osha Liang LLP

(57) ABSTRACT

A fixed-head drill bit includes a bit body having a plurality of cutting elements and at least one wear knuckle disposed on the bit body. Each cutting element includes a cutting surface defining a swept cutting profile when the bit is rotated about an axis. The at least one wear knuckle is positioned at least partially within and extending at least partially outside a selected one or more of the swept cutting profiles, allowing the fixed-head drill bit to wear into a more stable configuration.

22 Claims, 6 Drawing Sheets

FIXED-HEAD BIT WITH STABILIZING FEATURES

BACKGROUND OF INVENTION

1. Field of the Invention

The invention relates generally to fixed-head drill bits, and in particular to fixed-head drill bits having stabilizing features for, inter alia, improving stability while drilling.

2. Background Art

FIG. 1 shows a conventional fixed-head drill bit 5, sometimes referred to as a "fixed cutter" drill bit, for drilling into subterranean formations. Fixed-head bits typically rotate as one piece and contain no separately moving parts. Bit 5 typically includes a bit body 10 having an externally threaded connection for connecting to a drill string at one end 12, and a plurality of blades 14 extending from the other end of bit body 10. A plurality of cutting elements 16, sometimes referred to as "fixed cutters," each defining a cutting surface, are attached to the blades 14 to cut through earth formations when the bit 5 is rotated during drilling. The cutting elements 16 deform the earth formation by scraping and shearing. The cutting elements 16 may be tungsten carbide inserts, polycrystalline diamond compacts, milled steel teeth, or any other cutting elements of materials hard and strong enough to deform or cut through the formation. Hardfacing (not shown) may also be applied to the cutting elements 16 and other portions of the bit 5 to reduce wear and increase the life of the bit 5.

Polycrystalline diamond cutting elements are frequently used on fixed-head drill bits. One embodiment of polycrystalline diamond includes polycrystalline diamond compact ("PDC"), which comprises man-made diamonds aggregated into relatively large, inter-grown masses of randomly oriented crystals. Polycrystalline diamond is highly desirable, in part due to its relatively high degrees of hardness and wear resistance. Despite these properties, however, polycrystalline diamond will eventually wear down or otherwise fail after continued exposure to the stresses of drilling. Undesirable bit performance such as vibration and whirling while drilling exacerbates wear and tear on the cutting elements.

Many approaches have been devised to improve drill bit dynamic characteristics to reduce the detrimental effects to the drill bit. In particular, stabilizing features known as "wear knuckles", sometimes interchangeably referred to as "contact pads" or "wear knots", are used to stabilize the drill bit by controlling lateral movement of the bit, lateral vibration, and depth of cut. These stabilizing features project from the bit face, either trailing or leading a corresponding cutting element with respect to a rotational direction about a bit axis.

U.S. Pat. No. 6,568,492 discloses an example of a combination mill/drill bit employing stabilizing features referred to as "secondary ridge structures." The bit has primary cutting elements and secondary structures intended to enable continuous substantially smooth milling of down hole casing and subsequent drilling of an earth formation. The primary cutting elements are inserts made of polycrystalline diamond or other hard material. Secondary ridge structures having relatively blunt protrusions are intended to protect the primary cutting elements by absorbing impacts, limiting the primary cutting element engagement, controlling torque, and providing stability.

U.S. Pat. No. 6,659,199 discloses a rotary bit design including stabilizing features referred to as "elongated bearings." The elongated bearings are designed to travel within a tubular clearance volume defined by the path of a respective cutting element drilling through the formation. This placement of the bearing requires anticipating the helical path cut by the cutting element, which is a function of parameters such as: rates of penetration and rotational speeds. This placement is intended to minimize contact between the elongated bearing and the uncut rock adjacent the helical path cut by the cutting element.

One characteristic of fixed-head bits having conventional stabilizing features is that the cutting elements extend outwardly of the stabilizing features, to contact the formation in advance of the stabilizing features. The stabilizing features are designed not to contact the formation until the bit advances at a selected minimum rate or depth of cut ("DOC"). In many cases, stabilizing features therefore do not sufficiently support the fragile cutting surface. In other cases, the cutting elements may penetrate further into the formation than predicted by the stabilizing features, so that the cutting tips become overloaded despite the presence of the stabilizing features. Furthermore, the manufacturing process used to create these bits may not allow the accuracy required to consistently reproduce a desired minimum DOC. One or more stabilizing features may contact the formation while others have clearance. This imbalance can introduce additional instability. Therefore, an improved apparatus and method for stabilizing a drill bit are desirable.

SUMMARY OF INVENTION

According to one aspect of the invention, a fixed-head drill bit includes a bit body and a plurality of cutting elements disposed on the bit body. Each cutting element includes a cutting surface defining a swept cutting profile when the bit is rotated about an axis. At least one wear knuckle is disposed on the bit body, positioned at least partially within and extending at least partially outside a selected one or more of the swept cutting profiles, such that the at least one wear knuckle is configured to wear during engagement with a formation to appreciably conform to the shape of the one or more swept cutting profiles.

Other aspects of the invention relate to a method of manufacturing a fixed-head drill bit and a method of drilling with a fixed-head drill bit. Further aspects and advantages of the invention will be apparent from the following description and the appended claims.

BRIEF DESCRIPTION OF DRAWINGS

FIG. 6 shows wear knuckles limiting DOC in a lateral direction.

FIG. 7 shows wear knuckles limiting DOC in an axial direction.

FIG. 8 shows wear knuckles limiting DOC in both an axial and a lateral direction.

DETAILED DESCRIPTION

One aspect of this invention provides for more accurate control of the depth of cut of a drill bit by providing a geometry that will wear into an optimum shape for the desired depth of cut. By forming a wear knuckle to initially protrude into helical swept cutting profiles of cutting elements at selected locations and within a range of preselected interference volumes, the resulting bit can be made to wear into a more stable configuration. The interference between a wear knuckle and the swept cutting profiles of one or more cutting elements may be selected to limit depth of cut in an axial direction, a lateral direction, or both. According to some embodiments, wear knuckles on a blade are configured to interfere with helical cut paths cut by cutting elements proximately located on the same blade, and in other embodiments wear knuckles are configured to interfere with a combination of cut paths cut by cutting elements located on the same blade and/or on one or more other blades. Geometry and material blends of the wear knuckles can be manipulated to match the wear characteristics of the formations. According to some embodiments, this is done by matching the level of initial interference with the rock properties for a specific application.

Figure 1:
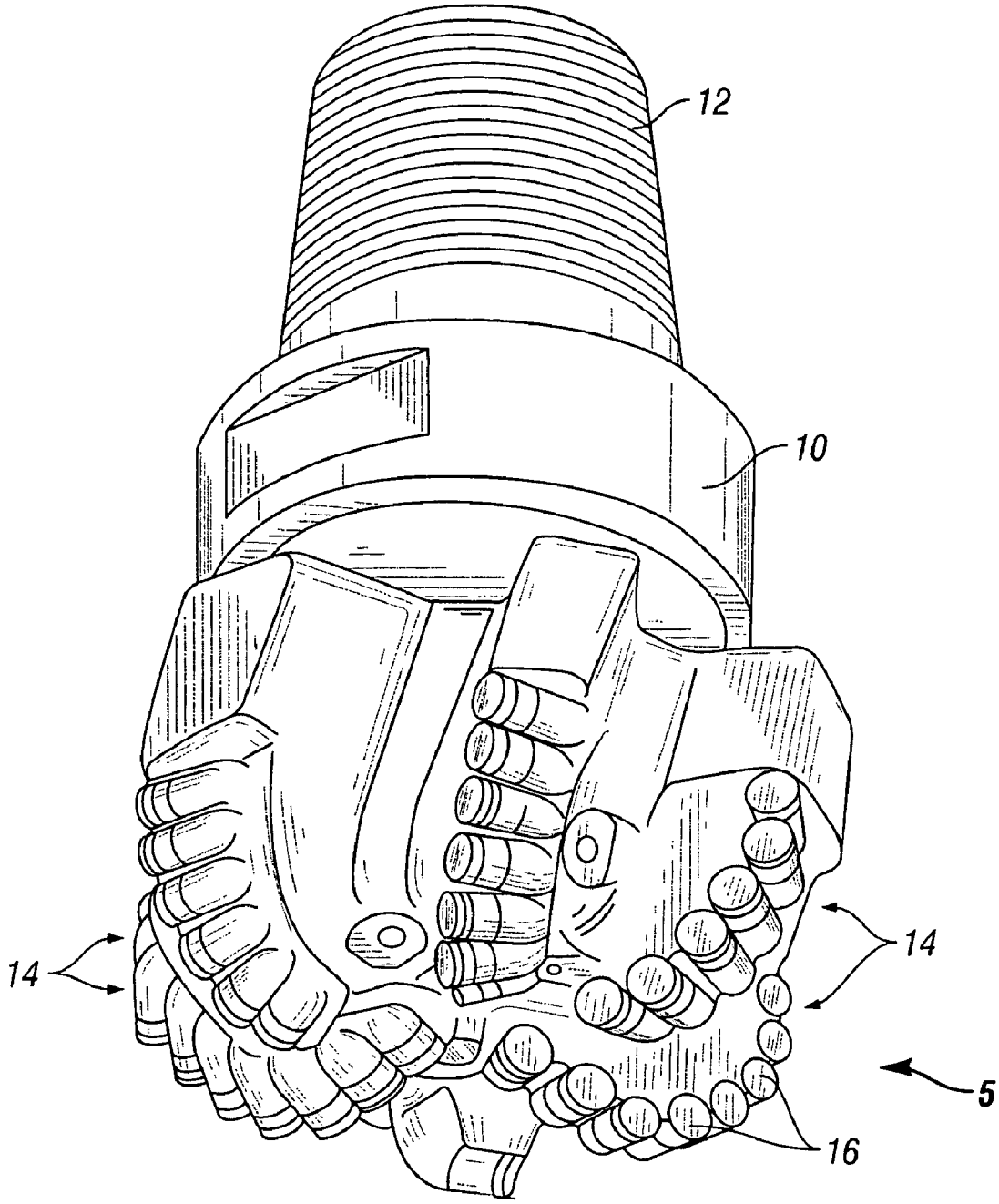
FIG. 1 (Prior Art)
FIG. 1 shows a conventional fixed-head drill bit for drilling into subterranean formations.
Figure 2:
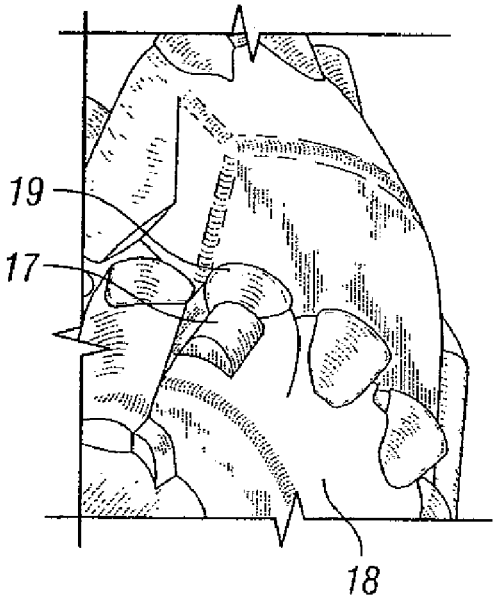
FIG. 2 shows a representative wear knuckle disposed on a blade trailing a cutting element.

FIG. 2 shows a representative wear knuckle 17 disposed on a blade 18. The representative wear knuckle 17 trails behind a cutting element 19 during rotation of the bit. The size, shape, and positioning of the wear knuckle 17 with respect to the cutting element 19 affects the depth of cut ("DOC") of the cutting element 19. In bits with conventional wear knuckles, the wear knuckles are typically configured to fit fully within the volumetric "cutting profile" swept by cutting elements, so as to limit DOC without intentionally contacting the formation. According to one aspect of the present invention, a wear knuckle is instead configured to extend outside the swept cutting profile of the corresponding cutting element to intentionally contact the formation, so that it may "break in," i.e. wear into a more optimal shape, substantially conforming to the shape of the swept cutting profile.

Figure 3:
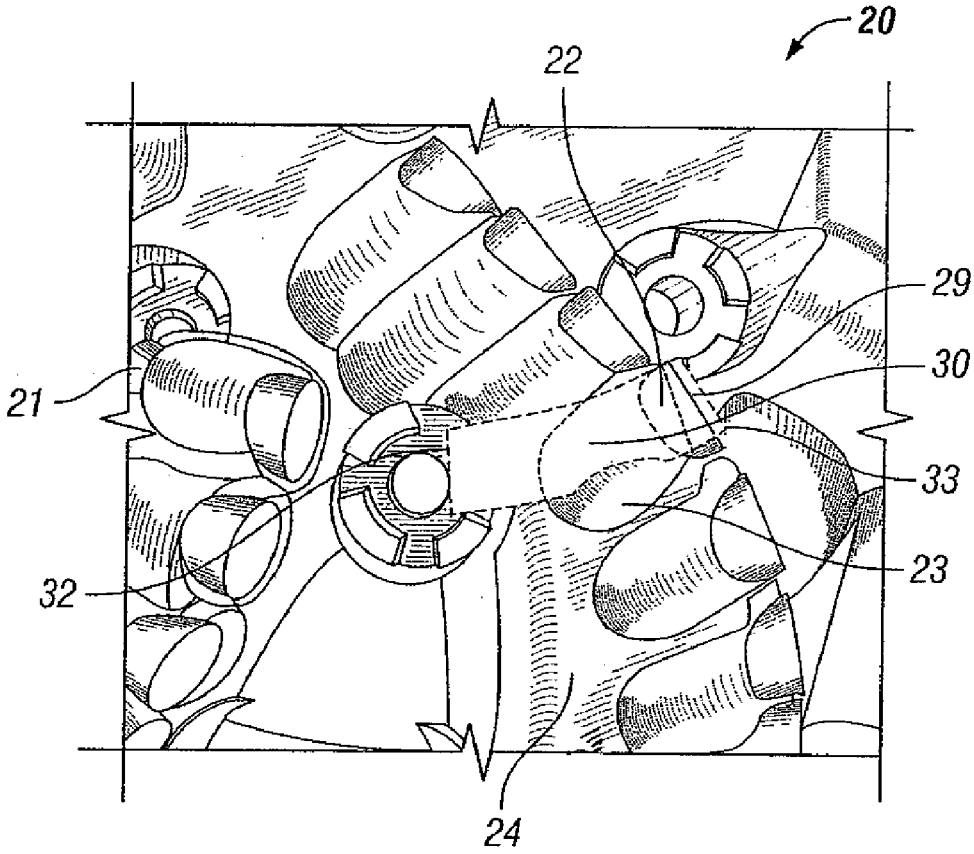
FIG. 3 shows an embodiment of a bit body having a plurality of cutting elements and a plurality of wear knuckles disposed on a plurality of blades.

FIG. 3 shows an embodiment of a bit body 20 according to at least one aspect of the invention. A plurality of blades 21 are disposed on the bit body 20. A plurality of cutting elements 22 and a plurality of wear knuckles 23 are disposed on each of the blades 21. Several of the cutting elements 22 and wear knuckles 23 are disposed on a blade 24, arranged radially outward with respect to an axis about which the bit rotates. In general, the layout of the cutting elements 22 and wear knuckles 23 in this embodiment of a drill bit is along an arcuate path. A variety of other fixed-head bit configurations are known, and those of ordinary skill in the art will appreciate that certain aspects of the invention discussed herein may be applicable to such other configurations.

Still referring to FIG. 3, each cutting element 22 includes a cutting surface 29 that defines a swept cutting profile when the bit is rotated about an axis. To illustrate, as the drill bit is rotated a partial turn to move cutting element 22 between locations 32 and 33, the cutting surface 29 sweeps a cutting profile 30 through space, interior to which the cutting element 22 passes. The cutting element 22 will cut a cut path in the formation that corresponds to the swept cutting profile 30. For the purpose of discussing the invention, the cut paths may be visualized with reference to the swept cutting profile 30.

Figure 4:
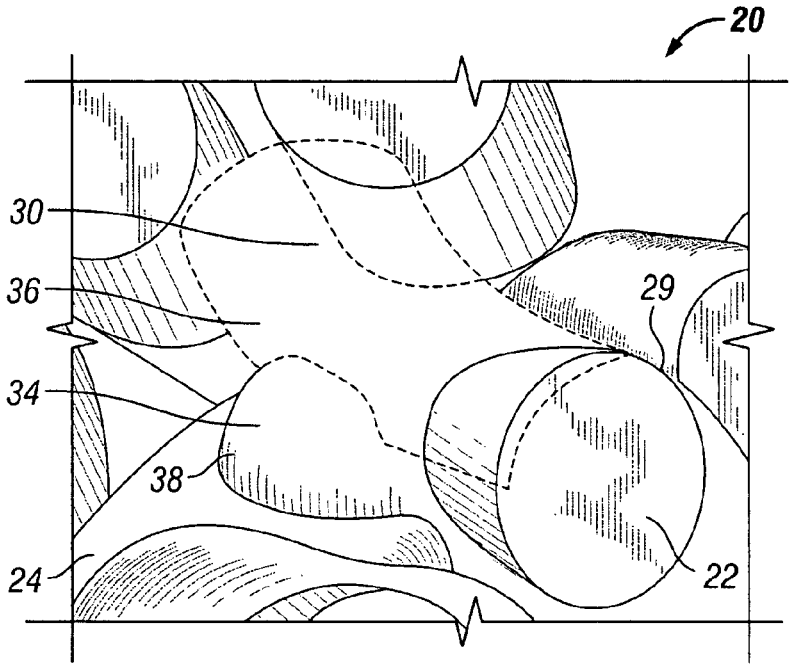
FIG. 4 shows an alternate view of the bit body of FIG. 3.

FIG. 4 shows an alternate view of the bit body 20. Wear knuckle 23 is integrally formed within the bit body 20, and in this embodiment is formed directly on blade 24. According to some embodiments, the wear knuckle 23, bit body 20, and/or blade 24 may be cast as a unitary structure. Wear knuckle 23 is positioned partially within and extends at least partially outside the swept cutting profile 30. Specifically, a portion 36 of wear knuckle 23 lies within the cutting profile 30 of a cutting element 28, and another portion 38 extends outside the cutting profile 30. Thus, as the bit rotates, portion 36 is intended to pass through the cut path cut by the advancing cutting surface 29, and portion 38 is intended to abrasively contact the formation interior to the cut path.

Referring still to FIG. 4, if the bit body 20 were to rotate in place at one axial position for a full rotation about its axis, the swept cutting profile 30 would form a closed ring. However, a drill bit typically advances axially while rotating during drilling, such that the swept cutting profile 30 takes on a substantially helical shape. During combined rotation and axial movement, each cutting element will therefore sweep a substantially helical cutting profile, as a function of one or more bit operating parameters. The bit operating parameters that influence the shape of the cutting profile may include rotation rate, axial advancement rate (i.e., rate of penetration, "ROP"), and axial engagement force (i.e., weight on bit, "WOB"). For example, if the bit is rotating slowly at a high ROP, or with a high WOB, the helical cut path will likely have a larger pitch than if the bit were rotating at high speed with minimal ROP or WOB. As a practical matter, of course, axial advancement rate and engagement force are at least somewhat interdependent, in that ROP generally increases with increasing WOB at a given rotation rate.

Figure 5:
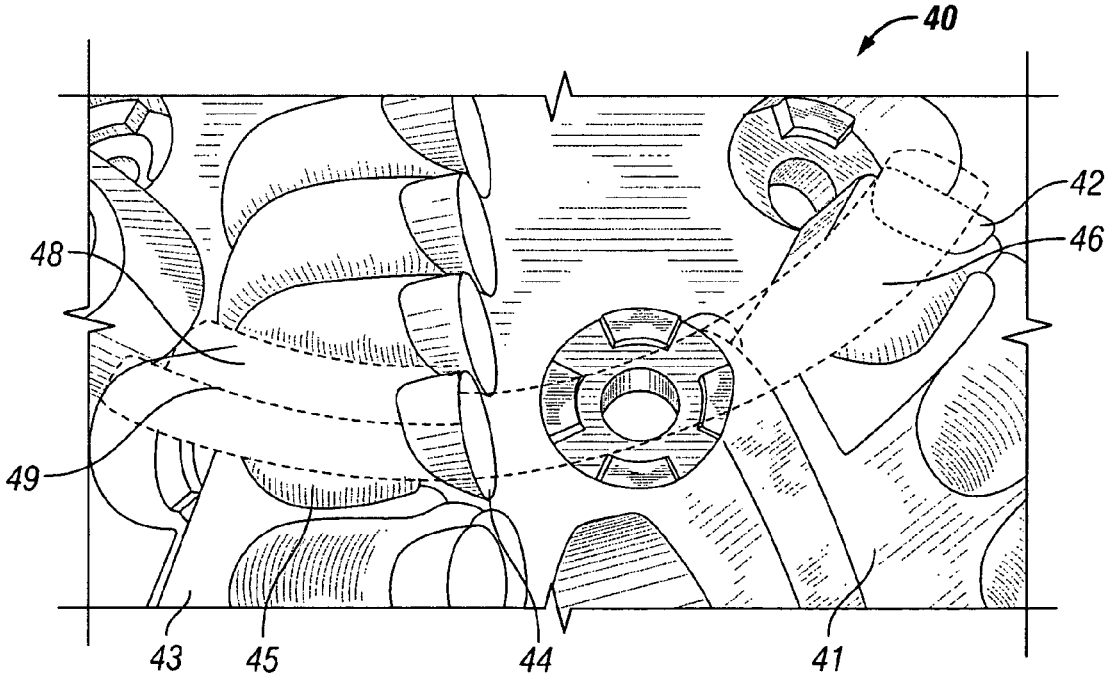
FIG. 5 shows a bit body having wear knuckles designed to interfere with cut paths cut by a proximately located cutting element located on the same blade, and with cut paths cut by cutting elements located on other blades.

FIG. 5 illustrates that wear knuckles may be designed to interfere not only with cut paths cut by a proximately located cutting element located on the same blade, but also with cut paths cut by cutting elements located on other blades, or in cut paths formed by combinations of cutting elements on both the same blade and other blades. FIG. 5 illustrates a portion of another bit body 40 similar to the bit body 20 of FIGS. 3 and 4. Cutting element 42 resides on blade 41, and cutting element 44 resides on another blade 43, with cutting element 42 leading cutting element 44 during rotation of the bit body 40 about its axis. Cutting element 42 sweeps cutting profile 46, and cutting element 44 sweeps cutting profile 48. Cutting profile 46 intersects cutting profile 48 along dashed line 49. In practice, due to manufacturing variations and tolerances, perfect alignment of cutting elements 42 and 44 may be impractical, potentially resulting in at least some intersection between profiles 46 and 48. However, according to some embodiments, cutting elements 42 and 44 may be intentionally positioned to produce this intersection of profiles 46 and 48.

The resulting cut path cut in the formation will, in principle, include the union of cutting profiles 46 and 48, and may possibly include the union of additional cutting profiles from cutting elements located elsewhere on the bit body 40. The wear knuckle 45 may therefore be positioned partly within and extend partly outside either or both of cutting profiles 46 and 48, and may be positioned partly within and extend partly outside the union of two or more cutting profiles. In other words, according to some embodiments, the planned level of interference between wear knuckles and cut paths may take into account not only the nearest cutting element on the same blade (such as the interference between knuckle 45 and profile 48), but also other cutting elements located on other blades (such as the interference between knuckle 45 and profile 46). The portion of the wear knuckle extending outside the cutting profiles is intended to contact and wear against the formation interior to the cut path, thereby taking on a shape approximating at least a portion of those cutting profiles. If the wear knuckle contacts multiple cut paths, the contacting portion will tend to take on a shape approximating the union of those multiple cut paths.

Figure 6:
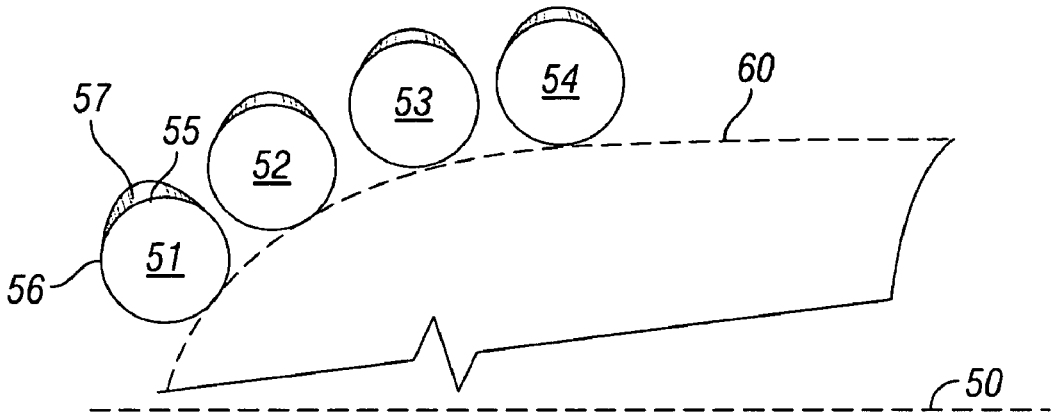
FIGS. 6-8 conceptually illustrate an arrangement of cutting elements along an arcuate portion of a bit body, such as a curved blade.
Figure 7:
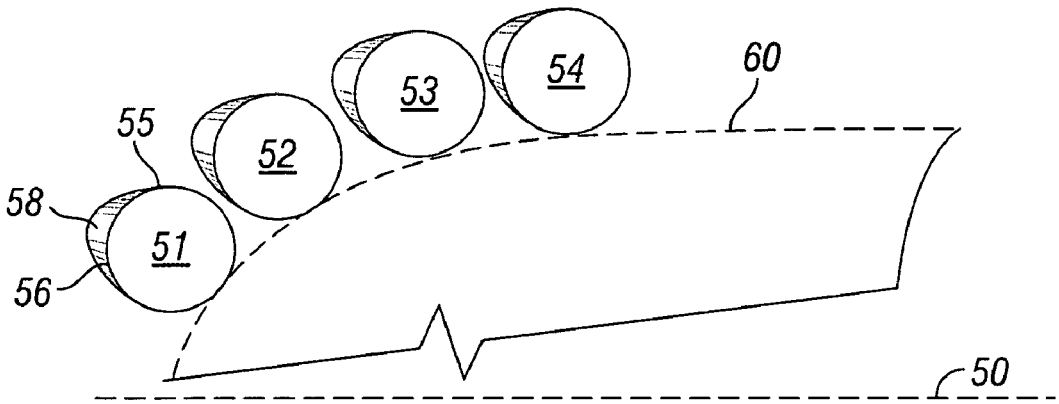
Figure 8:
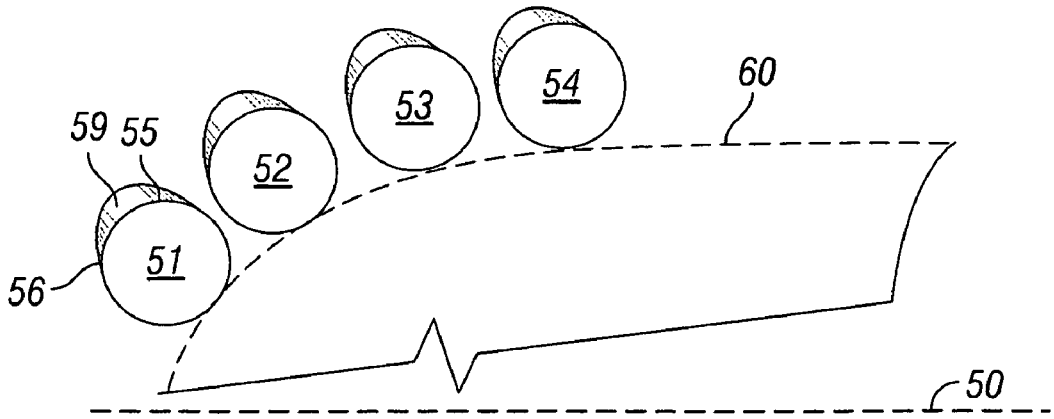

FIGS. 6-8 conceptually illustrate an arrangement of a plurality of cutting elements 51-54 along an arcuate portion of a bit body, such as a curved blade, represented by a dashed line 60. FIGS. 6-8, illustrate that the interference between wear knuckles and cutting profiles may be selected to limit depth of cut in an axial direction (FIG. 7), a lateral direction (FIG. 6), or both (FIG. 8). Also, interference between the wear knuckles and the formation may be selectively eliminated during manufacture of the bit at portions of the swept cutting profile that would not provide significant lateral stabilization. To limit depth of cut in a lateral direction, wear knuckles may be configured to extend outside the cutting profiles in a direction transverse to the bit axis, i.e. radially outward of the one or more cutting elements that define a particular cutting profile. As illustrated in FIG. 6, for example, wear knuckle 57 extends outside portion 55 of cutting element 51 (which is in a direction transverse to axis 50), and does not extend forward of axially leading portion 56 of cutting element 51. To limit depth of cut in an axial direction, wear knuckles may be configured to extend outside the cutting profiles in an axially leading direction. As illustrated in FIG. 7, for example, wear knuckle 58 extends axially forward of axially leading portion 56 of cutting element 51. In still other embodiments, wear knuckles may be configured to extend both axially forward and radially outward of a cutting profile. As illustrated in FIG. 8, for example, wear knuckle 59 extends outwardly of cutting element 51 at both axially leading portion 56 and radially outward portion 55.

Figure 9:
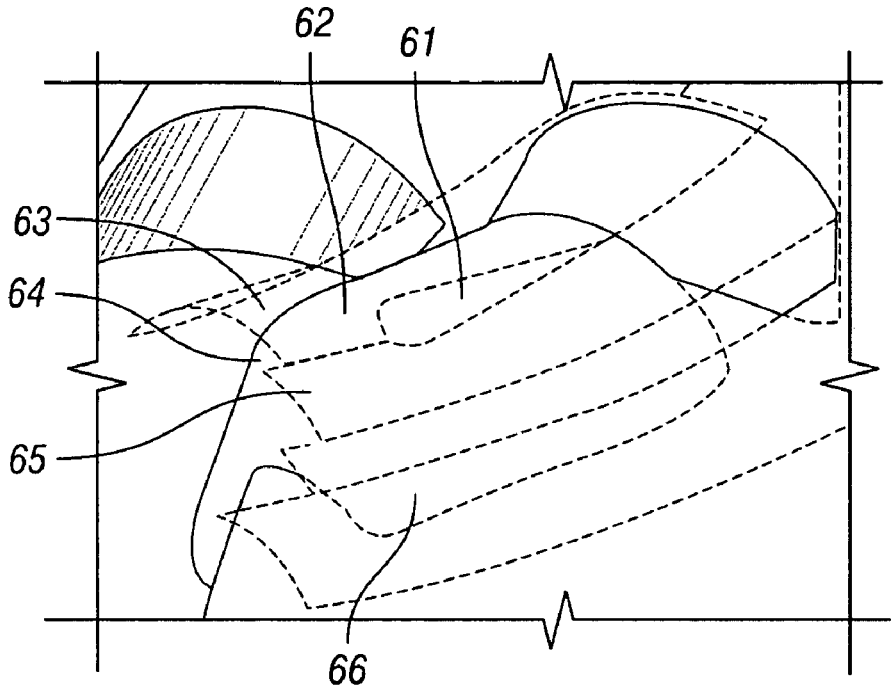
FIG. 9 shows wear knuckles configured to extend outside a central portion of one or more cutting profiles.

Referring to FIG. 9, wear knuckles may be configured to extend outside a central portion of one or more cutting profiles. For example, wear knuckle 62 includes a central portion 61 between two laterally outward portions 64, 66. Central portion 61 of wear knuckle 62 protrudes through the union of two cutting profiles 63, 65.

Figure 10:
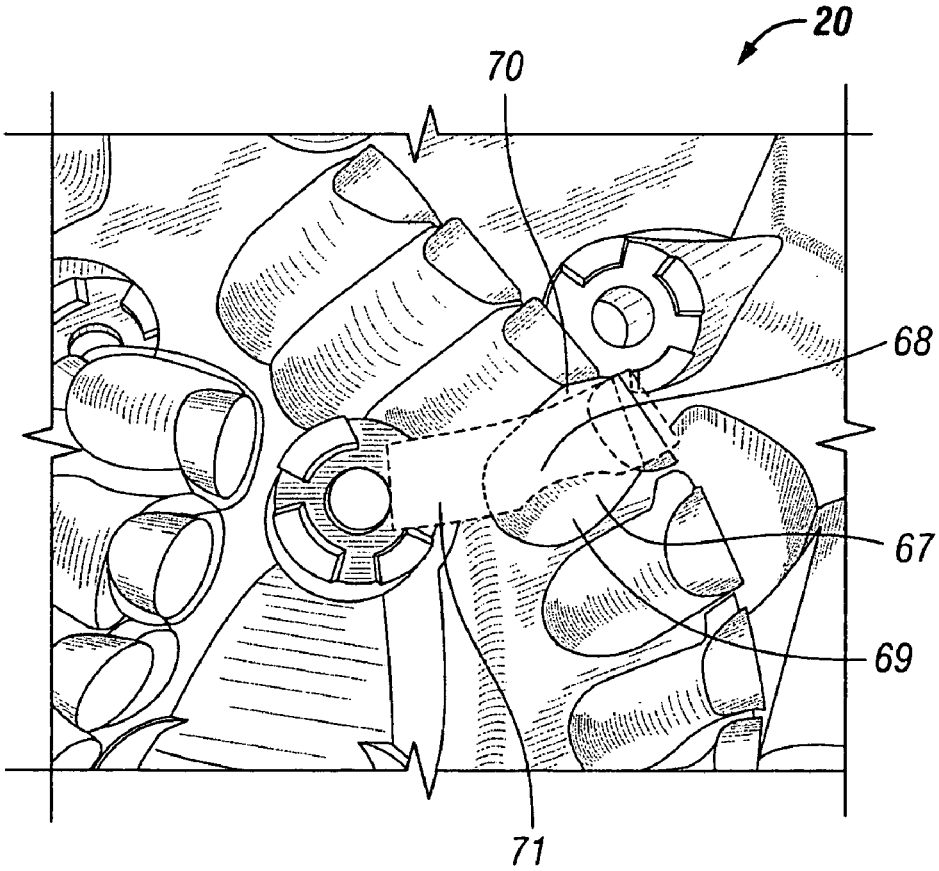
FIG. 10 shows wear knuckles configured to extend outside a laterally outward portion of one or more cutting profiles.

Alternatively, referring to the embodiment of FIG. 10, wear knuckles may be configured to extend outside a laterally outward portion of one or more cutting profiles. For example, a wear knuckle 67 includes a central portion 68 and laterally outward portions 69, 70. Central portion 68 is positioned within swept cutting profile 71, and does not contact the formation, whereas laterally outward portions 69, 70 extend outside the cutting profile 71 to contact the formation.

To match the wear characteristics of formations, wear knuckle geometry and material blends can be manipulated. According to an aspect of some embodiments, the amount by which a wear knuckle extends outside one or more cutting profiles may be quantified volumetrically. For example, referring back to FIG. 9, the wear knuckle 62 may be configured to protrude by a selected volume. Likewise, referring to FIG. 10, the volume of protrusion of laterally outward portions 69, 70 may be selected. The volume may be selected according to operating parameters such as the type of formation to be drilled or the mechanical properties of the wear knuckle material. The volume of interference may thus be matched with specific rock properties for a particular application.

According to another aspect of some embodiments, the amount by which a wear knuckle protrudes through one or more cutting profiles may alternatively be quantified by a linear distance. In some embodiments, for example, the wear knuckles are preferably configured to extend outside the selected one or more swept cutting profiles by a selected distance, e.g. at least 0.020 inch, to provide sufficient interference for allowing the wear knuckles to break-in. In other embodiments, the wear knuckles are preferably configured to extend outside the selected one or more swept cutting profiles by a selected upper limit, e.g. no more than 0.060 inch, to limit the break-in period, and to prevent excessive initial interference that could lead to erratic bit behavior prior to break-in. After proper break in, the protruding portion of the wear knuckle is intended to wear off so that the wear knuckle will not protrude outside of the desired cut path, or at least may not protrude as far outside the cut path.

For some embodiments of the invention, material selection is another variable to be considered. For example, because the wear knuckles are intended to break in to their optimal shape, the wear knuckles preferably have a wear resistance less than a wear resistance of the cutting elements, so that they wear faster and break in to their optimum shape while the cutting elements still have plenty of useful life remaining. However, the wear knuckles preferably have a hardness and wear resistance greater than those of the bit body. Harder, less abrasive formations may require softer wear knuckles.

Alternatively, the wear resistance of the wear knuckles may be altered using any method known in the art. For example, particularly on steel bodied bits, portions of the wear knuckles that are to be worn away during break in may comprise a less wear resistant material deposited on the remaining portions of the wear knuckles by physical vapor deposition, plasma arc, laser cladding, or any other suitable method. The hardness of matrix body bits may be altered by manipulating the carbide powder used to make the body and wear knuckles, or a different material (such as diamond or carbide bricks) can be added to the knuckle part of the bit.

Figure 11:
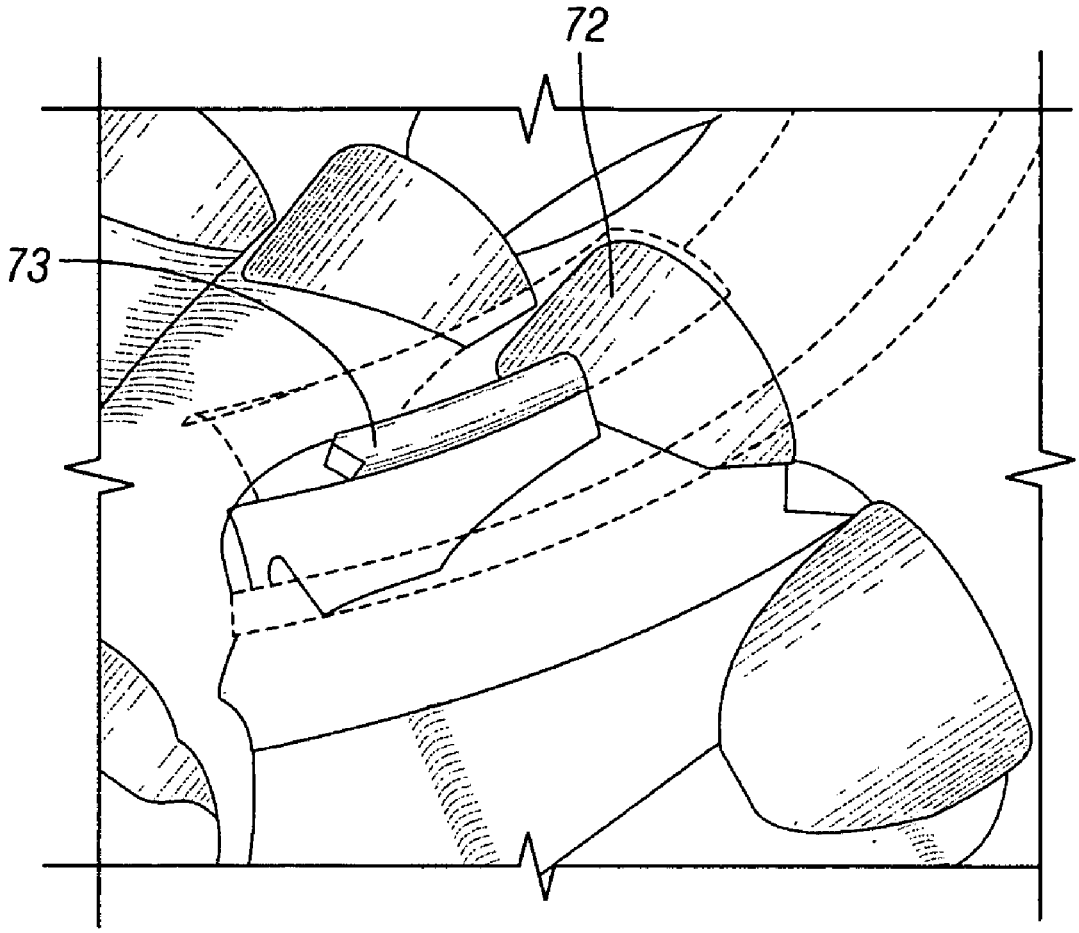
FIG. 11 shows a somewhat pointed or "triangular" wear knuckle.

In accordance with some embodiments of the invention, the shape and width of the wear knuckles may be pre-optimized for a given application. Pre-optimization or pre-configuration may be based on simulation or other information. FIG. 11, for example, illustrates a somewhat pointed or "triangular" wear knuckle 73 positioned behind a cutting element 72. This shape may limit the interference volume (discussed above), which may be better suited for harder, less abrasive formations. Harder and less abrasive formation generally require less interference. Softer, more abrasive formations may call for a higher volume of initial interference and/or a broader overall shape.

Another aspect of the invention involves breaking in and subsequently drilling with a bit configured as described. A "new" bit needs to be broken in to give the wear knuckles their optimal shape for drilling. According to some embodiments, however, the process of breaking in the bit is simply to drill into an earthen formation. Prior to full break in, the bit will perform differently, because initially the wear knuckles do not travel fully within the cut path, and they contact the formation by design. Thus, the bit operating parameters discussed above, such as rotation rate, ROP, and axial engagement force, may be different during break in than during subsequent drilling. For example, in some embodiments, a higher WOB may be recommended during break in to accelerate wear of the wear knuckles. In fact, a higher WOB may be required during break in to match the helical cutting profile that has been factored into the bit design. After break in, the method may further include adjusting one or more of the operating parameters. For example, the WOB may be reduced.

Despite initial interference of the wear knuckles, drilling of a borehole will typically progress during break in. This may be true in part due to abrasion of the formation by the wear knuckles and also because at least some portion of the cutting surfaces may engage the formation, despite the interference of the wear knuckles. Especially on softer formations, the wear knuckles may dig into the formation due to downforce on the bit, providing at least some DOC at the cutting elements along at least a portion of the cutting surfaces. Thus, the interfering wear knuckles according to some embodiments of the invention may merely serve to reduce—not eliminate—the initial DOC.

One aspect of the bit discussed above involves configuring the wear knuckles and corresponding cutting elements based on a predicted, typically helical cutting path of the cutting elements during break in and/or drilling. A related aspect of the bit's method of use according to one embodiment is to control the operating parameters to achieve substantially the same helical path during subsequent drilling, so that the wear knuckles continue to lend optimal stabilization to the bit during use. In other words, if the wear knuckles are broken in to accommodate a specified helical path, it is useful to continue operating the bit during its service life under conditions that would closely replicate that helical path.

Because precisely achieving a specified helical path may be impractical while drilling, it may be recommended in some embodiments to operate the drill bit within a predetermined range of parameters that would at least approximate the predicted path. Accordingly, it is useful to configure the wear knuckles and cutting elements during manufacture of the bit to account for this anticipated variation in the helical path. The wear knuckles may be configured to extend outside the respective swept cutting profiles over a range of helical paths corresponding to a range of operating parameters at which the bit is likely to be operated. In practice, the average helical pitch may vary between 0.001" for very hard formations and 0.500" for soft formations. Thus, in some embodiments the bit may be configured such that at least some of the wear knuckles are positioned within and extend outside corresponding swept cutting profiles having a broad helical pitch range of between 0.001" and 0.500." In other embodiments, such as where a bit is configured for use with a particular type of formation, a considerably narrower range of helical pitch may be selected.

One parameter affecting the swept cutting profiles that can be expected to vary is rate of penetration. In practice, instantaneous variations of up to 50% or more are not unusual. However, an average ROP can realistically be maintained within 15% of a selected value. Likewise, in some embodiments, the wear knuckles may be configured to be positioned within and extend outside corresponding cutting profiles at a selected average ROP, or within a selected range of up to 15% or more of the selected average ROP. For example, if the target ROP is 100 ft/hr, it may be possible to average between 85 and 115 ft/hr over the course of an hour.

The wear knuckles may be configured to radially and/or axially extend outward of the corresponding cutting elements by a selected distance at a selected ROP, such as by at least 0.020 inch, or within a selected range of distances, such as by between 0.020 and 0.060 inch. The ROP in a hard formation is commonly on the order of about 100 ft/hr and 80-120 RPMs. The ROP in a soft formation is commonly on the order of about 200-300 ft/hr and 120-250 RPMs. A bit for a hard formation may therefore be designed to have an interference of at least 0.020" at an ROP of 100 ft/hr. Likewise, a bit for a soft formation may be designed to have an interference of at least 0.020" at 300 ft/hr.

Increasing the ROP will increase the amount of interference between a wear knuckle and the swept cutting profile, due to the steeper angle of the helical path. However, by way of example, it has been determined that for a wear knuckle circumferentially trailing a corresponding cutting element by 1", increasing ROP from 100 to 300 ft/hr may only increase this interference by about 0.010". This rule of thumb may be taken into account in the design of a particular bit. For example, matrix bits typically have larger tolerances than steel body bits due to the less predictable nature of casting. The tolerance for manufacturing a particular bit may therefore be adjusted so that the minimum interference is likely to be at least 0.020". Interference greater than a specified minimum may be acceptable or even desirable, in contrast to prior art bits that intended to avoid interference.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A fixed-head drill bit comprising:

a bit body;

a plurality of cutting elements disposed on the bit body, each cutting element including a cutting surface defining a swept cutting profile when the bit is rotated about an axis; and at least one wear knuckle disposed on the bit body, positioned at least partially within and extending at least partially outside a selected one or more of the swept cutting profiles, such that the at least one wear knuckle is configured to wear into an optimized geometry during engagement with a formation to appreciably conform to the shape of the one or more swept cutting profiles.

2. The fixed-head drill bit of claim 1, wherein each swept cutting profile has a substantially helical shape as a function of one or more bit operating parameters.

3. The fixed-head drill bit of claim 2, wherein the helical shape of each swept cutting profile has a pitch of between 0.001 inches and 0.500 inches.

4. The fixed-head drill bit of claim 2, wherein the bit operating parameters include one or more of a selected rotation rate, a selected ROP, and a selected axial engagement force.

5. The fixed-head drill bit of claim 1, wherein the at least one wear knuckle extends outside the selected one or more cutting profiles in an axially leading direction.

6. The fixed-head drill bit of claim 1, wherein the at least one wear knuckle extends outside the selected one or more swept cutting profiles in a direction transverse to the bit axis.

7. The fixed-head drill bit of claim 1, wherein a central portion of the at least one wear knuckle extends outside the selected one or more cutting profiles.

8. The fixed-head drill bit of claim 1, wherein an outward portion of the at least one wear knuckle extends outside of the selected one or more cutting profiles.

9. The fixed-head drill bit of claim 1, wherein the at least one wear knuckle has a wear resistance less than a wear resistance of the cutting elements.

10. The fixed-head drill bit of claim 1, wherein the at least one wear knuckle extends outside the selected one or more of the swept cutting profiles by a selected volume.

11. The fixed-head drill bit of claim 1, wherein the at least one wear knuckle extends outside the selected one or more swept cutting profiles by a distance of at least 0.020 inch.

12. The fixed-head drill bit of claim 1, wherein the at least one wear knuckle extends outside the selected one or more swept cutting profiles by a distance of between 0.020 and 0.060 inch.

13. The fixed-head drill bit of claim 1, wherein the at least one wear knuckle comprises:

a plurality of wear knuckles.

14. The fixed-head drill bit of claim 13, further comprising:

one or more blades disposed on the bit body, at least some of the cutting elements being disposed on the blades.

15. The fixed-head drill bit of claim 14, wherein at least some of the wear knuckles are disposed on the blades.

16. The fixed-head drill bit of claim 13, wherein each of the wear knuckles is positioned within and extends outside only one of the swept cutting profiles.

17. A method of drilling with the drill bit of claim 1, comprising:

selecting one or more bit operating parameters; and engaging a formation with the fixed-head drill bit while operating the fixed-head drill bit according to the bit operating parameters, such that the at least one wear knuckle appreciably conforms to the shape of the one or more swept cutting profiles.

18. The method of claim 17, wherein the bit operating parameters comprise:

one or more of a selected rotation rate, a selected ROP, and a selected axial engagement force.

19. The method of claim 17, further comprising:

engaging the formation at an ROP within 15% of a selected average ROP.

20. A method of manufacturing a fixed-head drill bit, comprising:

forming a bit body;

disposing a plurality of cutting elements on the bit body, each cutting element including a cutting surface; and disposing at least one wear knuckle on the bit body to be positioned at least partially within and extending at least partially outside a cutting profile swept by a selected one or more of the cutting elements during operation of the drill bit according to the one or more bit operating parameters.

21. The method of claim 20, wherein the at least one wear knuckle is configured to extend outside the selected one or more cutting profiles by at least 0.020" for the fixed-head drill bit manufactured to drill at an ROP of 100 feet per hour and a rate of rotation of between 80 and 120 RPMs, for use on a relatively hard formation.

22. The method of claim 20, wherein the at least one wear knuckle is configured to extend outside the selected one or more cutting profiles by at least 0.020" for the fixed-head drill bit manufactured to drill at an ROP of 300 feet per hour and a rate of rotation of between 120 and 250 RPMs, for use on a relatively soft formation.

* * * * *